US006492887B1

(12) United States Patent
Diem et al.

(10) Patent No.: US 6,492,887 B1
(45) Date of Patent: Dec. 10, 2002

(54) MINIATURIZED FLAT SPOOL RELAY

(75) Inventors: Hans Diem, Richterswil (CH); Werner Johler, Au-Wädenswil (CH); Werner Kälin, Schwyz (CH); Urs Korrodi, Schönenberg (CH)

(73) Assignee: AxiCom Ltd., Wadenswil (CH)

( * ) Notice: Subject to any disclaimer, the term of this patent is extended or adjusted under 35 U.S.C. 154(b) by 0 days.

(21) Appl. No.: 09/554,175

(22) PCT Filed: Nov. 6, 1998

(86) PCT No.: PCT/CH98/00475

§ 371 (c)(1),
(2), (4) Date: Jun. 20, 2000

(87) PCT Pub. No.: WO99/27548

PCT Pub. Date: Jun. 3, 1999

(30) Foreign Application Priority Data

Nov. 20, 1997 (CH) ..... 2676/97

(51) Int. Cl.[7] ..... H01H 51/22

(52) U.S. Cl. ..... 335/78; 335/84; 335/179; 335/181; 335/229; 335/234

(58) Field of Search ..... 335/78–86, 229–234, 335/177, 179, 180, 181, 182

(56) References Cited

U.S. PATENT DOCUMENTS

| | | | | |
|---|---|---|---|---|
| 5,398,011 A | | 3/1995 | Kimura et al. | 335/79 |
| 5,531,018 A | | 7/1996 | Saia et al. | 29/622 |
| 5,889,452 A | * | 3/1999 | Vuilleumier | 335/80 |
| 6,094,116 A | * | 7/2000 | Tai et al. | 335/78 |

FOREIGN PATENT DOCUMENTS

| | | |
|---|---|---|
| EP | 0685864 | 12/1995 |
| EP | 0780858 | 3/1999 |

* cited by examiner

*Primary Examiner*—Ramon M. Barrera
(74) *Attorney, Agent, or Firm*—Bachman & LaPointe, P.C.

(57) ABSTRACT

The invention relates to a microrelay comprising a magnetic spool, a contact support body (2) within which contacts are arranged, a permanent magnet (32) and an armature (31) which is tiltable around it's axis between two positions, as well as a spring-loaded reversing system. The inventive micro relay is characterized in that the magnetic spool system (1) is configured as a flat spool system (1) in the form of a microstructure arranged on a flow plate (11) and is composed of at least one flat microspool (12'). The pivoting armature (31') can itself be configured in the form of a three pole magnet (32') or a two pole magnet (32"). The inventive microrelay has a minimal overall height and can be produced in a cost effective way in an automated manufacturing process.

3 Claims, 5 Drawing Sheets

MINIATURIZED FLAT SPOOL RELAY

Figure 1:
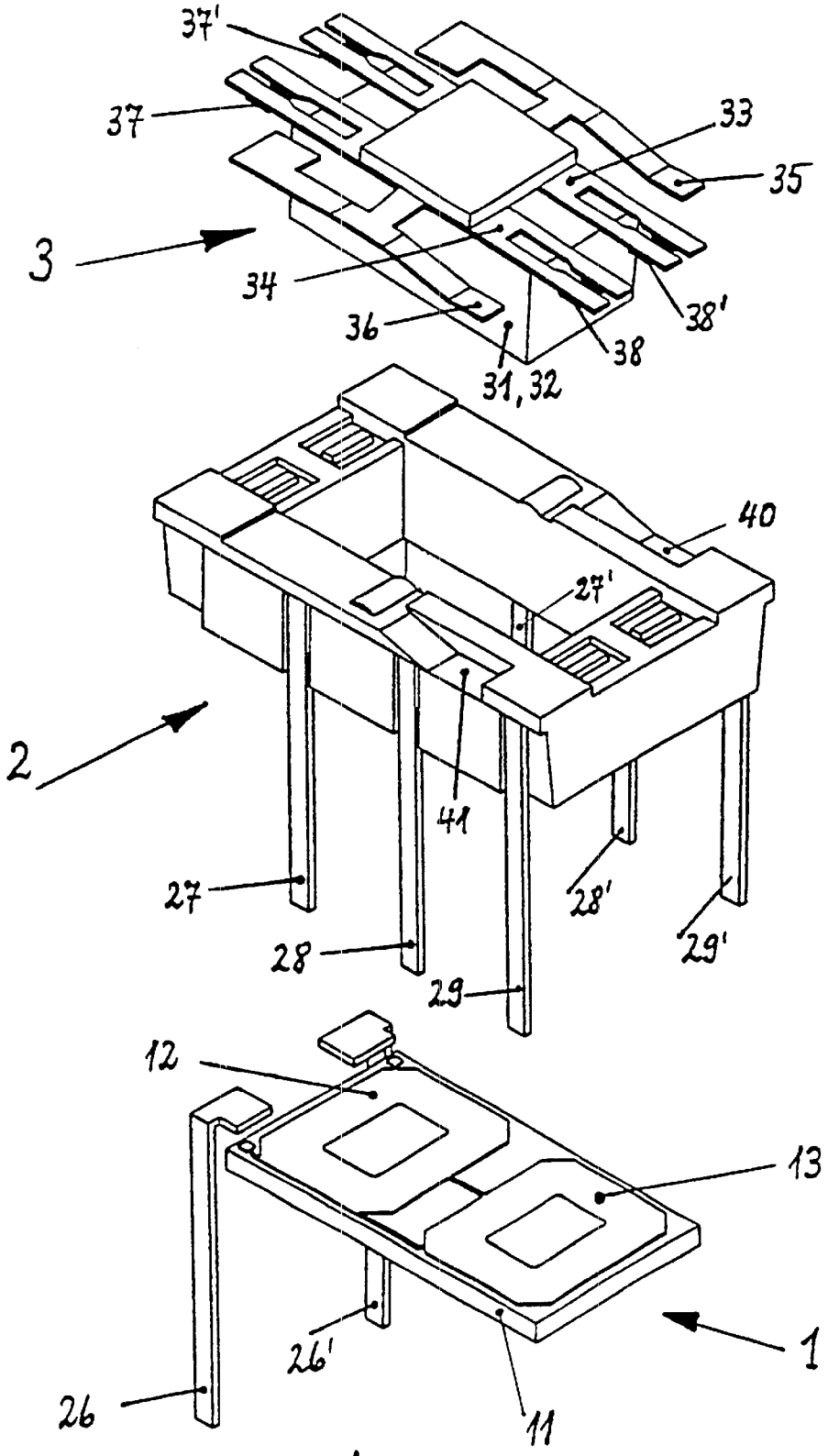

The present invention concerns a micro-relay consisting of a magnetic coil system, a contact carrier body with contacts arranged therein, a permanent magnet for the magnetic yoke and a rotor which can be tilted about its central axis between two positions and a switching spring system.

A multiplicity of relays with wound coils are known. EP, A1 0 373 109 for example discloses circuit board relays where a wound coil by way of a permanent magnet causes, by way of an induced magnetic flux, a rotor to perform a tilt movement whereby switching contact springs are activated. The disadvantage here, however, remains the lower limit of the resulting construction height due in particular to the space required for the wound coil, which restricts the applicability of such relays. Also the relatively high manufacturing costs of the wound coil and the complexity have proven disadvantageous.

The task of the invention is to provide a micro-relay of the type described initially which has a minimum construction height, contains only a few components and can be produced at low cost in automated production.

According to the invention this task is solved in that the magnetic coil system is formed as a flat coil system in the form of a microstructure produced on a flux plate and comprises at least one micro-flat coil. Advantageous and further developed embodiments of the object of the invention are the subject of the dependent claims.

The flat coil system preferably has two individually arranged micro-flat coils.

Figure 2:
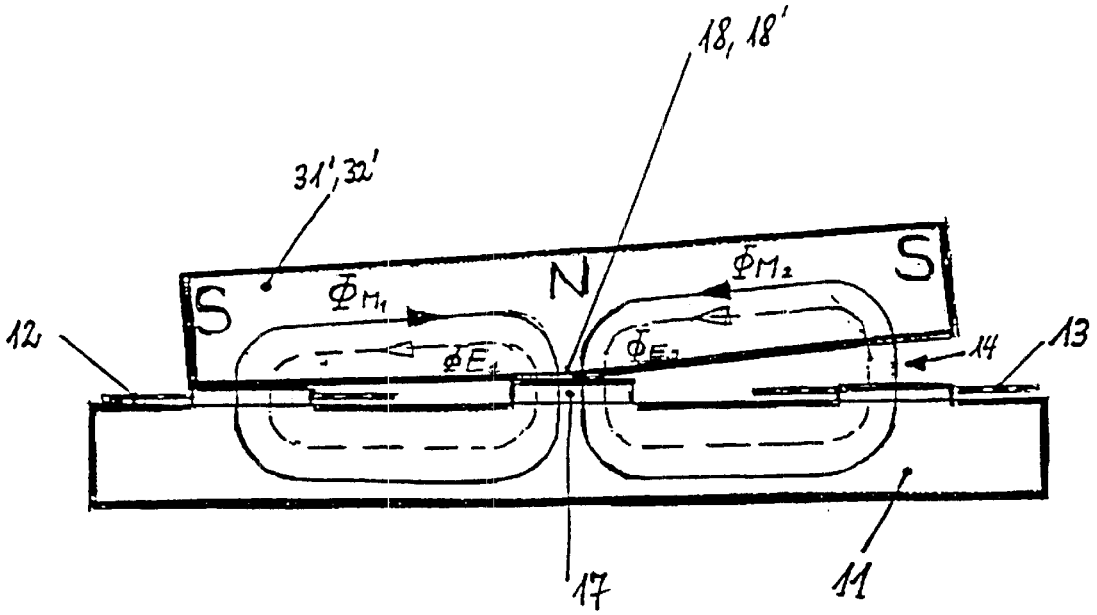
Figure 3:
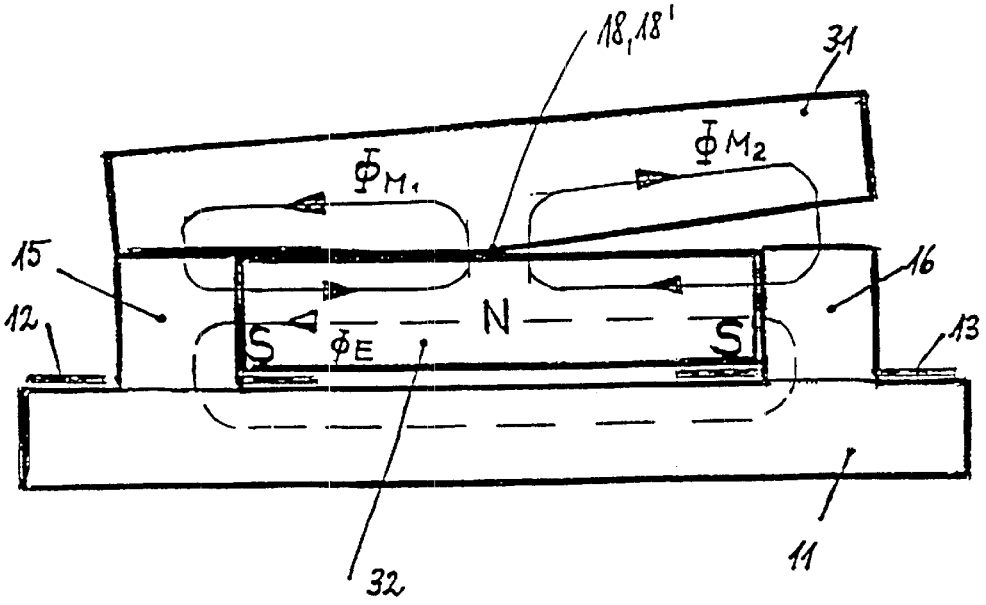
Figure 4:
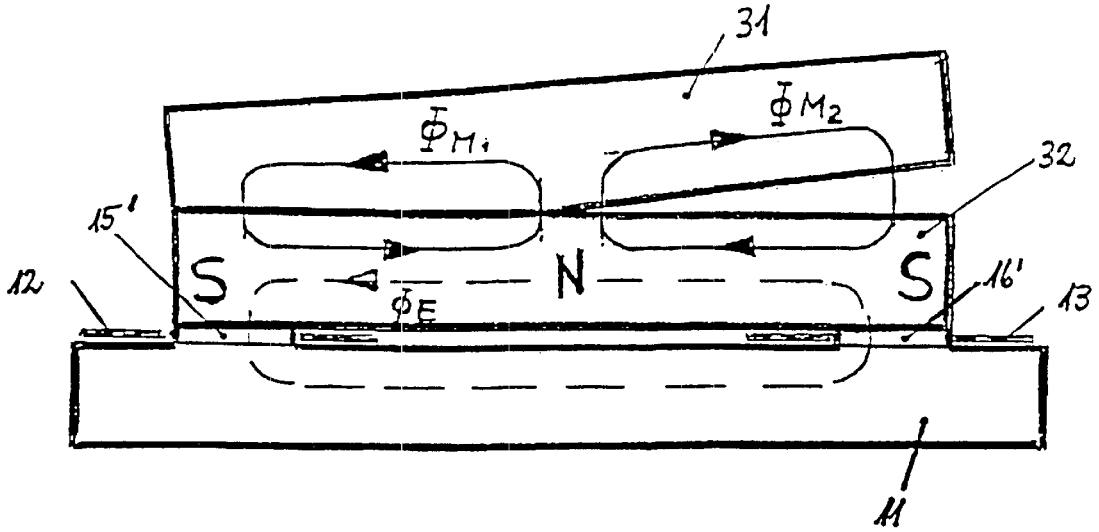
Figure 5:
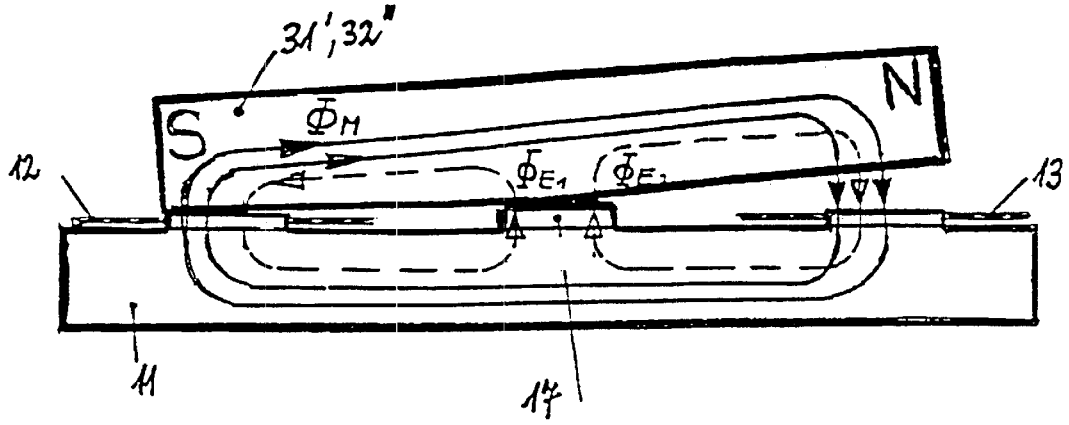
Figure 6:
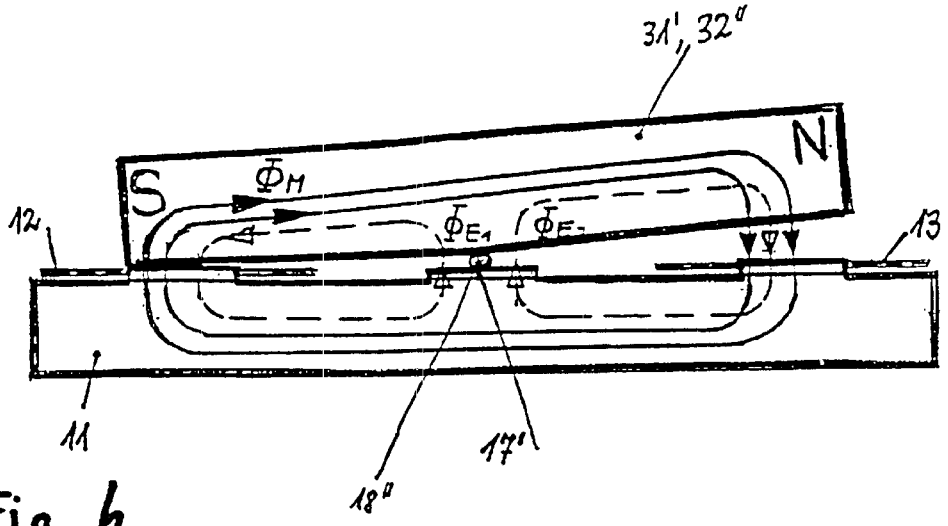
Figure 7:
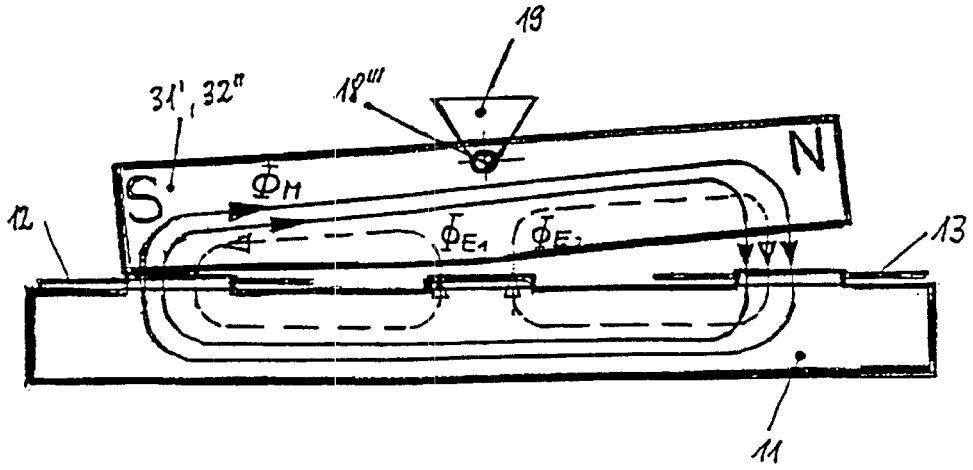
Figure 8:
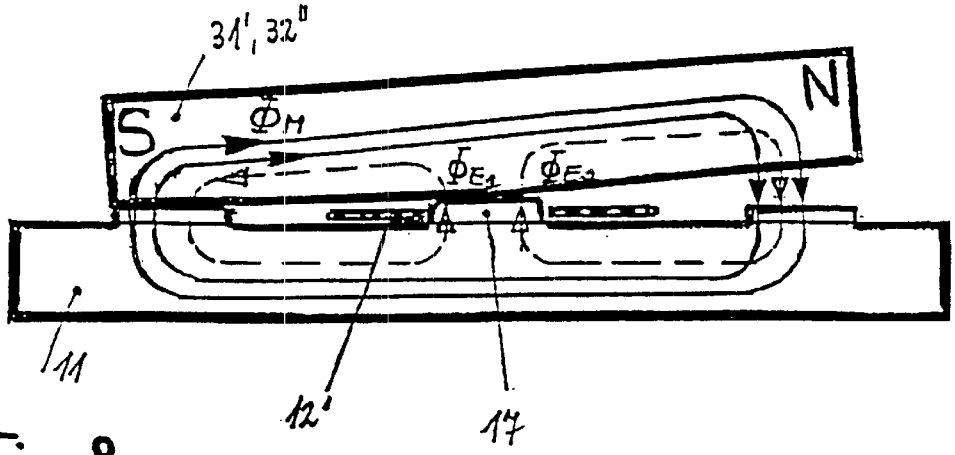
Figure 9:
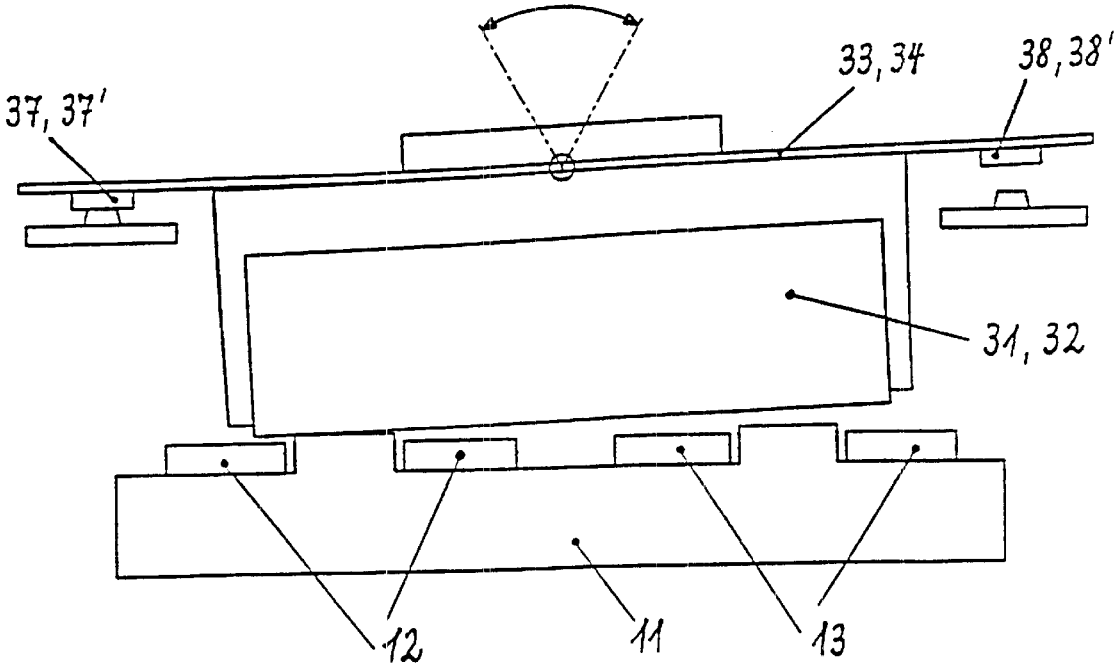

The invention is described in more detail using the design examples shown in the drawing which are also the subject of dependent claims. These show:

FIG. 1 an exploded view of the individual parts of the relay;

FIG. 2 an interior view of the long side of the main element of the relay with the contact carrier body removed;

FIG. 3 an embodiment similar to that of FIG. 2;

FIG. 4 an embodiment similar to that of FIG. 3;

FIG. 5 an embodiment similar to that of FIG. 2;

FIG. 6 an embodiment similar to that of FIG. 5;

FIG. 7 an embodiment similar to that of FIG. 6;

FIG. 8 an embodiment of the drive of the micro-relay with a centrally arranged flat coil, and FIG. 9 the transfer of the tilt movement of the rotor to the switching springs.

The multiple embodiments of the object of the invention—as shown in FIGS. 1 to 8—cannot be achieved in the same easy way with other previously known processes.

FIG. 1 shows the individual assemblies of the micro-relay in exploded view, namely a flat coil system 1, a contact carrier body 2 and a rotor and switching spring holder 3.

The flat coil system 1 consists of a flux plate 11 and two micro-flat coils 12 and 13 applied to this which are produced in a known manner using a suitable etching process from the specialist area of microstructure technology and powered by way of connecting tabs 26, 26'. The flat coil system 1, designed as a microstructure, serves as a drive for the tilt movement of the rotor 31 to activate the switching springs 33 and 34.

The contact carrier body 2 is a frame-like plastic injection moulding holding six terminal lugs by the surrounding injection moulding. The two long sides of contact carrier body 2 hold terminal lugs 27, 28, 29 and 27', 28', 29' respectively for the switching contacts.

In the rotor and switching spring holder 3 is arranged a rotor 31 designed as a prismatic rod which at the same time can be formed as a permanent magnet 32. Connections 35 and 36 are welded to points 40 and 41. As FIG. 9 shows, as a result of its tilt movement the rotor 31 activates the switching springs 33 and 34 which in turn close working contacts 37, 37' and rest contacts 38, 38' into the corresponding position.

FIG. 2 shows an inner view of the long side of the relay according to the invention where the corresponding side walls of the contact carrier body are cut away. The magnetic flux $\Phi_{E1}$ induced by the excited micro-flat coil 12 acts against the magnetic flux $\Phi_{M1}$ caused by the permanent magnet 32'. The magnetic flux $\Phi_{E2}$ induced by the excited micro-flat coil 13 however supports the magnetic flux $\Phi_{M2}$ caused by the permanent magnet 32' whereby the attraction force of the part magnets on the side of the air gap 14 becomes greater than the retaining force of the part magnets on the other side so that the permanent magnet 32' formed as rotor 31' tilts over its edge 18 or its curved contour 18' into the working position. The movement is transferred to the switching springs 33, 34 in the known manner whereby the switching process of the micro-relay is triggered. In order to return the permanent magnet to the other position, the resulting fluxes must be set such that the tilt movement is triggered with the help of the supporting spring effect of the switching springs 33, 34. This can be achieved by switching the polarity of the power source.

FIG. 3 shows an embodiment in which permanent magnet 32 induces in rotor 31 the magnetic fluxes $\Phi_{M1}$ and $\Phi_{M2}$ with different flux direction. The magnetic flux $\Phi_E$ induced by micro-flat coils 12 and 13 by way of cores 15 and 16 in the permanent magnet 32 supports magnetic flux $\Phi_{M2}$ and acts against magnetic flux $\Phi_{M1}$ so that the rotor 31 tilts into the working position. In order to return the rotor to the other position the flux direction of the micro-coil flux $I_E$ must be reversed, for example in the same way as described in the section above.

The functional method of the embodiment in FIG. 4 is similar to that of the previous section where the cores 15' and 16', arranged in the centre of the micro-flat coils 12 and 13, have a height which is only slightly above the thickness of the micro-coils.

FIG. 5 shows an embodiment where in contrast to FIG. 2 the rotor 31' is designed as a two-pole permanent magnet 32". The magnetically conductive central core 17 causes an amplification of magnetic flux $\Phi_{E1}$. The magnetic flux $\Phi_M$ is around twice as great as the magnetic flux $\Phi_{E1}$. Therefore flux $\Phi_M$ is shown as a double line. $\Phi_{E1}$ is subtracted from $\Phi_M$, $\Phi_{E2}$ is added to $\Phi_M$, whereby in a similar manner to that described above, the tilt movement of the rotor 31', designed as a permanent magnet, is triggered.

FIG. 6 shows an embodiment based on FIG. 5 with a magnetically non-conductive rotary support 17' instead of a magnetically conductive central core. Because of the greater resistance due to the air gap, a smaller magnetic flux $\Phi_{E1}$ results. The ratio $\Phi_{E1}$ to $\Phi_{E2}$ is less than in the embodiment described under FIG. 5 as there is a greater resistance over the air gap with the rotary support. The functional principle remains the same.

FIG. 7 shows an embodiment according to FIG. 6 with the difference that the rotary axis 18'"is further away from the flux plate 11. The mounting 19 of rotary axis 18'"can be provided on the contact carrier body 2.

FIG. 8 shows an embodiment with a single micro-flat coil 12' arranged about a magnetically conductive central core 17. The magnetic fluxes $\Phi_{E1}$ and $\Phi_M$ are subtracted and magnetic fluxes $\Phi_{E2}$ and $\Phi_M$ added, whereby again a tilt movement is achieved of the rotor 31', designed as a permanent magnet 32" in the manner already described.

The function of the micro-relay is now briefly described with reference to FIG. 1.

The flat coil system, designed as a microstructure, serves to drive the tilt movement of rotor 31. The tilt movement is triggered by the corresponding interaction of magnetic fluxes $\Phi_{E1}$, $\Phi_{M1}$, $\Phi_{E2}$, $\Phi_{M2}$, $\Phi_E$, $\Phi_M$ as explained in detail above. Because of its tilt movement, the rotor activates the switching springs 33 and 34 which in turn close working contacts 37, 37' and rest contacts 38, 38' respectively into the corresponding position.

The advantages of the object of the invention are that low construction heights can be achieved. It is essential that the flat coil system produced according to the invention allows a miniaturisation of the relay. By layer construction the coils of the contacts can be separated in an optimum manner. Also due to the use of modern galvanic processes production of the flat micro-coils is particularly favourable in the manner known to the expert. A reduction in conductor insulation achieves a very high efficiency. In contrast to conventional wound coils, it allows a massive reduction in process steps for production. Thus for example soldering of the coil ends and the associated use of flux agents which can be contact-damaging for the microclimate of the relay, can be omitted. Also low-cost joining technologies e.g. bonding can be used. The insulation material of conventional insulation of the coil wires also has a negative effect on the microclimate. A further advantage of the present invention is consequently the omission of this contact-damaging insulation material. The use of a flux plate made of iron as a system carrier ensures an extraordinarily stable precondition for SMD suitability. There is therefore a high temperature stability for the SMD solder process.

What is claimed is:

1. Micro-relay consisting of a magnetic coil system, a carrier body with contacts arranged therein, a rotor operating as a permanent magnet and as a return path for the induced magnetic flux of at least one coil, the rotor is tiltable about a central axis between two positions to activate a switching spring system, where the magnetic coil system is formed as a flat coil system in the form of a microstructure produced on a flux plate and comprises at least one micro-flat coil, wherein the rotor is swivellable about the central axis, and is formed as one of (1) a 3-pole permanent magnet and (2) a 2-pole permanent magnet.

2. Micro-relay according to claim 1 including two micro-flat coils and between the two micro-flat coils is arranged a magnetically conductive central core also formed flat.

3. Micro-relay according to claim 1 wherein the rotary axis of rotors lies at a defined distance above the flux plate.

* * * * *